US008206517B1

(12) United States Patent
Bush et al.

(10) Patent No.: US 8,206,517 B1
(45) Date of Patent: Jun. 26, 2012

(54) ALUMINUM ALLOYS HAVING IMPROVED BALLISTICS AND ARMOR PROTECTION PERFORMANCE

(75) Inventors: Dustin M. Bush, Bay Village, OH (US); Ian Murray, Avon, OH (US); Roberto J. Rioja, Murrysville, PA (US); Ralph R. Sawtell, Gibsonia, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 12/356,476

(22) Filed: Jan. 20, 2009

(51) Int. Cl.
*C22C 21/10* (2006.01)

(52) U.S. Cl. ..... 148/417; 420/532

(58) Field of Classification Search ..... 148/417; 420/532

See application file for complete search history.

(56) References Cited

U.S. PATENT DOCUMENTS

| | | | | |
|---|---|---|---|---|
| 3,135,633 | A | 6/1964 | Hornus | 148/695 |
| 3,305,410 | A | 2/1967 | Sublett et al. | 148/159 |
| 3,542,606 | A | 11/1970 | Westerman et al. | 148/694 |
| 3,645,804 | A | 2/1972 | Ponchel | 148/502 |
| 3,836,405 | A | 9/1974 | Staley et al. | 148/502 |
| 3,856,584 | A | 12/1974 | Cina | 148/701 |
| 3,881,966 | A | 5/1975 | Staley et al. | 148/502 |
| 3,945,860 | A | 3/1976 | Winter et al. | 148/502 |
| 3,947,297 | A | 3/1976 | Reimann et al. | 148/695 |
| 4,090,011 | A | 5/1978 | Barkman et al. | 428/653 |
| 4,189,334 | A | 2/1980 | Dubost et al. | 148/502 |
| 4,200,476 | A | 4/1980 | Dubost et al. | 148/502 |
| 4,294,625 | A | 10/1981 | Hyatt et al. | 148/550 |
| 4,323,399 | A | 4/1982 | Dubost et al. | 148/695 |
| 4,345,951 | A | 8/1982 | Coupry et al. | 148/550 |
| 4,431,467 | A | 2/1984 | Staley et al. | 148/701 |
| 4,477,292 | A | 10/1984 | Brown | 148/502 |
| 4,488,913 | A | 12/1984 | Ferton | 148/502 |
| 4,618,382 | A | 10/1986 | Miyagi et al. | 148/415 |
| 4,648,913 | A | 3/1987 | Hunt et al. | 148/693 |
| 4,747,890 | A | 5/1988 | Meyer | 148/439 |
| 4,797,165 | A | 1/1989 | Bretz et al. | 148/695 |
| 4,816,087 | A | 3/1989 | Cho | 148/692 |
| 4,828,631 | A | 5/1989 | Ponchel et al. | 148/417 |
| 4,832,758 | A | 5/1989 | Brown | 148/695 |
| 4,863,528 | A | 9/1989 | Brown et al. | 148/695 |
| 4,946,517 | A | 8/1990 | Cho | 148/693 |
| 4,954,188 | A | 9/1990 | Ponchel et al. | 148/694 |
| 4,961,792 | A | 10/1990 | Rioja et al. | 148/552 |

(Continued)

FOREIGN PATENT DOCUMENTS

| | | |
|---|---|---|
| EP | 677779 | 2/1999 |

(Continued)

OTHER PUBLICATIONS

*Aluminum and Aluminum Alloys*, ASM International, pp. 23-24, 124, (1993).

(Continued)

*Primary Examiner* — Roy King
*Assistant Examiner* — Janelle Morillo
(74) *Attorney, Agent, or Firm* — Greenberg Traurig, LLP

(57) ABSTRACT

New 7XXX alloys having improved ballistics performance are disclosed. The new alloys generally are resistant to armor piercing rounds at 2850 fps, resistant to fragment simulated particles at 2950 fps, and are resistant to spalling. To achieve the improved ballistics properties, the alloys are generally overaged so as to obtain a tensile yield strength that is (i) at least about 10 ksi lower than peak strength and/or (ii) no greater than 70 ksi.

4 Claims, 2 Drawing Sheets

U.S. PATENT DOCUMENTS

| | | | | |
|---|---|---|---|---|
| 4,988,394 | A | 1/1991 | Cho | 148/693 |
| 5,047,092 | A | 9/1991 | Faure | 148/439 |
| 5,066,342 | A | 11/1991 | Rioja et al. | 148/693 |
| 5,108,520 | A | 4/1992 | Liu et al. | 148/701 |
| 5,110,372 | A | 5/1992 | Faure | 148/552 |
| RE34,008 | E | 7/1992 | Quist et al. | 148/417 |
| 5,151,136 | A | 9/1992 | Witters et al. | 148/689 |
| 5,213,639 | A | 5/1993 | Colvin et al. | 148/693 |
| 5,221,377 | A | 6/1993 | Hunt et al. | 148/417 |
| 5,240,522 | A | 8/1993 | Tanaka et al. | 148/693 |
| 5,277,719 | A | 1/1994 | Kuhlman et al. | 148/694 |
| 5,413,650 | A | 5/1995 | Jarrett et al. | 148/690 |
| 5,496,426 | A | 3/1996 | Murtha | 148/691 |
| 5,560,789 | A | 10/1996 | Sainfort et al. | 148/549 |
| 5,759,302 | A | 6/1998 | Nakai et al. | 148/415 |
| 5,865,911 | A | 2/1999 | Miyasato et al. | 148/439 |
| 6,027,582 | A | 2/2000 | Shahani et al. | 148/417 |
| 6,048,415 | A | 4/2000 | Nakai et al. | 148/417 |
| 6,342,111 | B1 | 1/2002 | Meki et al. | 148/417 |
| 6,595,467 | B2 | 7/2003 | Schmidt | 244/119 |
| 6,790,407 | B2 | 9/2004 | Fridlyander et al. | 420/532 |
| 6,972,110 | B2 | 12/2005 | Chakrabarti et al. | 420/532 |
| 7,097,719 | B2 | 8/2006 | Bray et al. | 148/417 |
| 7,214,281 | B2 | 5/2007 | Lulian et al. | 148/550 |
| 2002/0150498 | A1 | 10/2002 | Chakrabarti et al. | 420/532 |
| 2003/0116608 | A1 | 6/2003 | Litwinski | 228/112.1 |
| 2004/0136862 | A1 | 7/2004 | Bray et al. | 420/532 |
| 2005/0011932 | A1 | 1/2005 | Ehrstrom et al. | 228/112.1 |
| 2005/0058568 | A1 | 3/2005 | Boselli et al. | 420/531 |
| 2005/0098245 | A1 | 5/2005 | Venema et al. | 148/688 |
| 2005/0150578 | A1 | 7/2005 | Bes et al. | 148/439 |
| 2005/0150579 | A1 | 7/2005 | Chakrabarti et al. | 148/439 |
| 2005/0189044 | A1 | 9/2005 | Benedictus et al. | 148/552 |
| 2005/0269000 | A1 | 12/2005 | Denzer et al. | 148/701 |
| 2006/0054666 | A1 | 3/2006 | Ehrstrom et al. | 228/227 |
| 2006/0174980 | A1 | 8/2006 | Benedictus et al. | 148/552 |
| 2006/0182650 | A1 | 8/2006 | Eberl et al. | 420/532 |
| 2006/0191609 | A1 * | 8/2006 | Dangerfield et al. | 148/552 |
| 2007/0151636 | A1 | 7/2007 | Buerger et al. | 148/552 |
| 2008/0283163 | A1 | 11/2008 | Bray et al. | 148/690 |

FOREIGN PATENT DOCUMENTS

| | | |
|---|---|---|
| EP | 377779 | 9/2001 |
| EP | 829552 | 7/2003 |
| EP | 1544315 | 6/2005 |
| EP | 1799391 | 3/2006 |
| FR | 2853666 | 10/2004 |
| FR | 2872172 | 12/2005 |
| JP | 58161747 | 9/1983 |
| JP | 58213852 | 12/1983 |
| JP | 5928555 | 2/1984 |
| JP | 2001335874 | 12/2001 |
| WO | WO2006086534 | 8/2006 |
| WO | WO2008156532 | 12/2008 |

OTHER PUBLICATIONS

*Aluminum Wrought Products*, Metals Handbook, 2nd ed., pp. 422, 445-460, (1998).

*International alloy designations and chemical composition limits for wrought aluminum and wrought aluminum alloys*, Registration Record Series, Aluminum Association, Washington, DC, US, XP002903949, pp. 1-26 (Jan. 1, 2004).

*International Search Report* from PCT/US2008/006253 (Dec. 16, 2008).

*Metals Handbook: Desk Edition*, ASM International, 2nd ed., pp. 419-421, (1998).

Dorward, R., *Enhanced Corrosion Resistance in Al—Zn—Mg—Cu Alloys*, Extraction, Refining and Fabrication of Light Metals, pp. 383-391 (1990).

Fridlyander, J., *Advanced Russian Aluminum Alloys*, Aluminum Alloys: Their Physical and Mechanical Properties, Proceedings ICAA4 vol. II, pp. 80-87 (Sep. 11-16, 1994).

Fridlyander, S., *Development and Application of High Strength Al—Zn—Mg—Cu Alloys*, Aluminum Alloys: Their Physical and Mechanical Properties, Proceedings ICAA5; Materials Science Forum, vol. 217-222, Switzerland, pp. 1813-1818 (1996).

Hatch, J., *Aluminum: Properties and Physical Metallurgy*, American Society for Metals, pp. 367-368 (1984).

Islam et al., *Retrogression and Reaging Response of 7475 Aluminum Alloy*, Metals Technology, vol. 10, pp. 386-392 (Oct. 1983).

Rajan et al., *Microstructural Study of a High-Strength Stress-Corrosion Resistant 7075 Aluminum Alloy*, Journal of Materials Science, vol. 17, pp. 2817-2824 (1982).

Teleshov, et al., *Influence of Chemical Composition on High- and Low-Cycle Fatigue with Zero-Start Extension of Sheets of D16 and V95 Alloys*, Russian Metallurgica, Moscow, pp. 141-144 (1983).

Shahani, R. et al., *High Strength 7XXX Alloys for Ultra-Thick Aerospace Plate: Optimisation of Alloy Composition*, Aluminum Alloys, vol. 2, pp. 1105-1110 (Jul. 5-10, 1998).

Tumanov, A.T., *Use of Aluminum Alloys*, Moscow, Metalurgia Publishers, pp. 131-133, 139 (1973).

Tumanov, A.T., *Application of Aluminum Alloy*, Moscow, Metalurgia Publishers, pp. 181 (1973).

Wallace, W., *A New Approach to the Problem of Stress Corrsion Cracking in 7075-T6 Aluminum*, Canadian Aeronautics & Space Journal, vol. 27, No. 3, pp. 222-232 (1981).

Warner, T.J. et al. *Aluminum Alloy Developments for Affordable Airframe Structures*, Third ASM International Paris Conference on Synthesis, Processing and Modeling of Advanced Materials, pp. 79-88 (1997).

Chinella, J. F., "High-Strength Al—Cu—Li and Al—Zn Alloys: Mechanical Properties with Statistical Analysis of Ballistic Performance," Pub. No. ARL-TR-3185, pp. 1-61, U.S. Army Research Laboratory, Apr. 2004.

Smith B., "The Boeing 777," Advanced Materials & Processes, pp. 41-44, Sep. 2003.

Publication No. AMS 4206A, "Aluminum Alloy, Plate (7055-T7751) 8.0Zn—2.3Cu—2.0Mg—0.16Zr Solution Heat Treated, Stress Relieved, and Overaged," pp. 1-5, SAEAerospace, Aug. 2006.

Publication No. MIL-DTL-46027K(MR), "Armor Plate, Aluminum Alloy, Weldable 5083, 5456, & 5059," pp. 1-28, U.S. Army Research Laboratory, Jul. 2007.

Publication No. MIL-A-46063G, "Armor Plate, Aluminum Alloy, 7039," pp. 1-26, U.S. Army Materials Technology Laboratory, Dec. 1992.

Publication No. MIL-DTL-46192C(MR), Amendment 1, "Aluminum Alloy Armor Rolled Plate (½to 4 Inches Thick), Weldable (Alloy 2519)," pp. 1-21 and Appendix A, U.S. Army Research Laboratory, Feb. 2000.

Publication No. DRSTA-P-702-108, "Product Assurance Pamphlet: Inspection of Aluminum Alloy Armor for Tank-Automotive Vehicles," U.S. Army Tank-Automotive Command, Feb. 1982.

Publication No. MIL-A-22771D, "Military Specification Aluminum Alloy Forgings, Heat Treated," 1999 and 2007.

Publication No. MIL-DTL-45225F (MR), "Detail Specification Aluminum Alloy Armor, Forged," U.S. Army Research Laboratory, Aberdeen Proving Ground, MD, Apr. 22, 1998.

Publication No. MIL-DTL-46063H, Amendment 1, "Detail Specification Armor Plate, Aluminum Alloy, 7039," U.S. Army Research Laboratory, Aberdeen Proving Ground, MD, Aug. 26, 1999.

Publication No. ANSI H35.1, "American National Standard Alloy and Temper Designation Systems for Aluminum," The Aluminum Association Inc., 2009.

Publication No. MIL-DTL-32375 (MR), "Detail Specification Armor Plate, Aluminum Alloy, 7085, Unweldable Applique," pp. 1-25, U.S. Army Research Laboratory, Sep. 2011.

"$V_{50}$ Ballistic Test for Armor," Department of Defense Test Method Standard, U.S. Army Research Laboratory, Document MIL-STD-662F, pp. 1-17, Dec. 18, 1997.

Cheeseman, B., et al., "Ballistic Evaluation of Aluminum 2139-T8," 2th *International Ballistics Symposium*, New Orleans, LA, Sep. 22-26, 2008.

Gooch, W. A. et al., "Ballistic Testing of Commercial aluminum alloys and Alternate Processing Techniques to Increase the Availability of Aluminum Armor," 23rd *International Symposium on Ballistics*, Tarragona, Spain, Apr. 16-22, 2007.

Rinnovatore, J. V., et al., "Correlation Determinations Between Stress Corrosion Characteristics of Wrought 7039 Aluminum Armor and Other Alloy Characteristics - Ballistic Performance, Yield Strength, and Electrical Conductivity," pp. 1-26, Frankford Arsenal Technical Report FA-TR-75026, Apr. 1975.
Vruggink, J. E., "Study of Improved Aluminum Materials for Vehicular Armor," pp. 1-172, Frankford Arsenal Technical Report No. FA-54-76073, Defense Technical Information Center, Accession No. ADA039488, Apr. 1977.

* cited by examiner (units in millimeters)

V50 vs. Thickness for 7039

ALUMINUM ALLOYS HAVING IMPROVED BALLISTICS AND ARMOR PROTECTION PERFORMANCE

BACKGROUND

High strength aluminum alloys, such as 7XXX series aluminum alloys, may be employed in various industries, such as in the military. However, it is difficult to achieve 7XXX alloys that have a good combination of armor piercing (AP) resistance, fragment simulated particle (FSP) resistance and spall resistance.

SUMMARY OF THE DISCLOSURE

Broadly, the present disclosure relates to an improved 7XXX series aluminum alloy having an improved combination of armor piercing (AP) resistance, fragment simulated particle (FSP) resistance, and spall resistance.

The new 7XXX series alloy is generally an ingot cast (e.g., direct chill cast), wrought aluminum alloy (e.g., rolled sheet or plate, extrusion, or forging). The alloy generally comprises (and in some instances consists essentially of) zinc, copper and magnesium as main alloying ingredients, with zirconium (or other appropriate element) being added for grain structure control. Some embodiments of the composition of the aluminum alloy are illustrated in Table 1, below.

TABLE 1

Composition of The Improved 7XXX Series Aluminum Alloy

| | Zn | Mg | Cu | Zr | Al |
|---|---|---|---|---|---|
| Alloy 1 | 7-9.5 | 1.3-1.68 | 1.2-1.9 | 0.01-0.40 | Balance |
| Alloy 2 | 7-8.5 | 1.4-1.68 | 1.3-1.8 | 0.05-0.25 | Balance |
| Alloy 3 | 7-8.0 | 1.5-1.68 | 1.4-1.7 | 0.08-0.12 | Balance |

Alloy 1 comprises (and in some instances consists essentially of) from about 7.0% Zn to about 9.5% Zn, from about 1.3% Mg to about 1.68 wt. % Mg, from about 1.2 wt. % Cu to about 1.9 wt. % Cu, from about 0.01-0.40 wt. % Zr, the balance essentially aluminum and incidental elements and impurities.

Alloy 2 comprises (and in some instances consists essentially of) from about 7.0% Zn to about 8.5% Zn, from about 1.4% Mg to about 1.68 wt. % Mg, from about 1.3 wt. % Cu to about 1.8 wt. % Cu, from about 0.05-0.25 wt. % Zr, the balance essentially aluminum and incidental elements and impurities.

Alloy 3 comprises (and in some instances consists essentially of) from about 7.0% Zn to about 8.0% Zn, from about 1.5% Mg to about 1.68 wt. % Mg, from about 1.4 wt. % Cu to about 1.7 wt. % Cu, from about 0.08-0.12 wt. % Zr, the balance essentially aluminum and incidental elements and impurities.

The alloys of the present disclosure generally include the stated alloying ingredients, the balance being aluminum, optional grain structure control elements, optional incidental elements and impurities. As used herein, "grain structure control element" means elements or compounds that are deliberate alloying additions with the goal of forming second phase particles, usually in the solid state, to control solid state grain structure changes during thermal processes, such as recovery and recrystallization. Examples of grain structure control elements include Zr, Sc, V, Cr, Mn, and Hf, to name a few.

The amount of grain structure control material utilized in an alloy is generally dependent on the type of material utilized for grain structure control and the alloy production process. When zirconium (Zr) is included in the alloy, it may be included in an amount up to about 0.4 wt. %, or up to about 0.3 wt. %, or up to about 0.2 wt. %. In some embodiments, Zr is included in the alloy in an amount of 0.05-0.15 wt. %. Scandium (Sc), vanadium (V), chromium (Cr), Manganese (Mn) and/or hafnium (Hf) may be included in the alloy as a substitute (in whole or in part) for Zr, and thus may be included in the alloy in the same or similar amounts as Zr.

As used herein, "incidental elements" means those elements or materials that may optionally be added to the alloy to assist in the production of the alloy. Examples of incidental elements include casting aids, such as grain refiners and deoxidizers.

Grain refiners are inoculants or nuclei to seed new grains during solidification of the alloy. An example of a grain refiner is a ⅜ inch rod comprising 96% aluminum, 3% titanium (Ti) and 1% boron (B), where virtually all boron is present as finely dispersed $TiB_2$ particles. During casting, the grain refining rod is fed in-line into the molten alloy flowing into the casting pit at a controlled rate. The amount of grain refiner included in the alloy is generally dependent on the type of material utilized for grain refining and the alloy production process. Examples of grain refiners include Ti combined with B (e.g., $TiB_2$) or carbon (TiC), although other grain refiners, such as Al—Ti master alloys may be utilized. Generally, grain refiners are added in an amount of ranging from 0.0003 wt. % to 0.005 wt. % to the alloy, depending on the desired as-cast grain size. In addition, Ti may be separately added to the alloy in an amount up to 0.03 wt. % to increase the effectiveness of grain refiner. When Ti is included in the alloy, it is generally present in an amount of up to about 0.10 or 0.20 wt. %.

Some alloying elements, generally referred to herein as deoxidizers (irrespective of whether the actually deoxidize), may be added to the alloy during casting to reduce or restrict (and is some instances eliminate) cracking of the ingot resulting from, for example, oxide fold, pit and oxide patches. Examples of deoxidizers include Ca, Sr, and Be. When calcium (Ca) is included in the alloy, it is generally present in an amount of up to about 0.05 wt. %, or up to about 0.03 wt. %. In some embodiments, Ca is included in the alloy in an amount of 0.001-0.03 wt % or 0.05 wt. %, such as 0.001-0.008 wt. % (or 10 to 80 ppm). Strontium (Sr) may be included in the alloy as a substitute for Ca (in whole or in part), and thus may be included in the alloy in the same or similar amounts as Ca. Traditionally, beryllium (Be) additions have helped to reduce the tendency of ingot cracking, though for environmental, health and safety reasons, some embodiments of the alloy are substantially Be-free. When Be is included in the alloy, it is generally present in an amount of up to about 20 ppm.

Incidental elements may be present in minor amounts, or may be present in significant amounts, and may add desirable or other characteristics on their own without departing from the alloy described herein, so long as the alloy retains the desirable characteristics described herein. It is to be understood, however, that the scope of this disclosure should not/cannot be avoided through the mere addition of an element or elements in quantities that would not otherwise impact on the combinations of properties desired and attained herein.

As used herein, impurities are those materials that may be present in the alloy in minor amounts due to, for example, the inherent properties of aluminum and/or leaching from contact with manufacturing equipment. Iron (Fe) and silicon (Si) are examples of impurities generally present in aluminum alloys.

The Fe content of the alloy should generally not exceed about 0.25 wt. %. In some embodiments, the Fe content of the alloy is not greater than about 0.15 wt. %, or not greater than about 0.10 wt. %, or not greater than about 0.08 wt. %, or not greater than about 0.05 or 0.04 wt. %. Likewise, the Si content of the alloy should generally not exceed about 0.25 wt. %, and is generally less than the Fe content. In some embodiments, the Si content of the alloy is not greater than about 0.12 wt. %, or not greater than about 0.10 wt. %, or not greater than about 0.06 wt. %, or not greater than about 0.03 or 0.02 wt. %.

Except where stated otherwise, the expression "up to" when referring to the amount of an element means that that elemental composition is optional and includes a zero amount of that particular compositional component. Unless stated otherwise, all compositional percentages are in weight percent (wt. %).

This new aluminum alloy achieves an improved combination of armor piercing resistance, fragment simulated particle resistance, and spall resistance, particularly when overaged relative to peak strength, and achieves a tensile yield strength (TYS) that is (i) at least about 10 ksi less than that of peak strength (e.g., in a T74 temper) and/or not greater than 70 ksi. In one embodiment, the alloy is overaged and has a TYS that is at least about 11 ksi less than that of peak strength. In other embodiments, the alloy is overaged and has a TYS that is at least about 12 ksi less than, or at least about 13 ksi less than, or at least about 14 ksi less than that of peak strength. In one embodiment, the alloy is overaged and has a strength of not greater than 70 ksi. In other embodiments, the alloy is overaged and has a strength of not greater than 69 ksi, or not greater than 68 ksi. In one embodiment, the alloy is overaged and has a strength of at least about 64 ksi. In other embodiments, the alloy is overaged and has a strength of at least about 65 ksi, or at least about 66 ksi. In one embodiment, the alloy is overaged and has a strength in the range of 65 ksi to 70 ksi. In other embodiments, the alloy is overaged and has a strength in the range of 65 ksi to 69 ksi, or 66 to 69 ksi, or 66 to 68 ksi. It is anticipated that alloys having a TYS higher than 70 ksi and/or a TYS close to peak strength may be susceptible to AP rounds, FSPs, and/or spalling, as described in further detail below.

As used herein, "armor piercing resistance" and the like means that an armor component produced from the new 7XXX alloy achieves an armor piercing $V_{50}$ ballistics limit of at least about 2850 feet per second (fps). In one embodiment, the armor piercing resistance is at least 2900 fps. In other embodiments, the armor piercing resistance is a least about 2950 fps, or at least about 3000 fps.

As used herein, "armor piercing $V_{50}$ ballistics limit" and the like means that the armor component achieves the stated $V_{50}$ ballistics limit, as defined in MIL-STD-662F(1997) when tested in accordance with MIL-STD-662F(1997), and utilizing the following conditions:

(a) the round is a 0.30 cal APM2 armor piecing round;
(b) the round is fired using a universal gun mount for 0.30cal APM2 testing, with a barrel chambered for a 30-06 Springfield cartridge;
(c) the testing sample has a thickness of 1.655 inches +/−0.003 inch;
(d) the testing sample is located at least 22 feet from the muzzle of the gun; and
(e) the pass/fail analysis is based on the ability of the testing samples to stop the threat round and protect an aluminum witness plate (Sections 3.41 and 5.2.2 of MIL-STD-662F(1997)) located behind the target—the testing sample fails if the witness panel is damaged due to the test such that light can pass through it (damage to the witness panel can be caused either by the round or by spall from the testing sample); otherwise, the testing sample passes.

As used herein, "fragment simulate particle resistance" and the like means that an armor component produced from the alloy achieves a fragment simulated particle V50 ballistics limit of at least about 2950 fps. In one embodiment, the armor piercing resistance is at least 3000 fps. In other embodiments, the armor piercing resistance is a least about 3100 fps, or at least about 3200 fps.

As used herein, "fragment simulated particle $V_{50}$ ballistics limit" and the like means that the armor component achieves the stated $V_{50}$ ballistics limit, as defined in MIL-STD-662F (1997) when tested in accordance with MIL-STD-662F (1997), and utilizing the following conditions:

(a) the round is a 20 mm fracture simulated particle manufactured according to MIL-P-46593A, where the material is 4340 steel having a blunt nose, has a weight of about 830 grains, an overall length of 0.912 inches, and has a main body diameter of 0.784 inches;
(b) the round is fired in the Medium Caliber Range and from rifled barrels without the use of sabots;
(c) the testing sample has a thickness of 1.635 inches +/−0.003 inch;
(d) the testing sample is located at least 22 feet from the muzzle of the gun; and
(e) the pass/fail analysis is based on the ability of the testing samples to stop the threat round and protect an aluminum witness plate (Section 3.41 and 5.2.2) of MIL-STD-662F(1997)) located behind the target—the testing sample fails if the witness panel is damaged due to the test such that light can pass through it (damage to the witness panel can be caused either by the round or by spall from the testing sample); otherwise, the testing sample passes.

In one embodiment, an armor component produced from the alloy is spall resistant. As used herein, "spall resistant" and the like means that, during ballistics testing conducted in accordance with MIL-STD-662F(1997)), no substantial detachment or delamination of a layer of material in the area surrounding the location of impact occurs, as visually confirmed by those skilled in the art, which detachment or delamination may occur on either the front or rear surfaces of the test product.

The overaging of the instantly disclaimed alloy may be completed in a multi-step aging process. In one embodiment, the multi-step aging process is a 3-stage artificial aging practice. The first step in the 3-stage practice is aging in the range of 200° F.-250° F. (e.g., 225° F.) for about 3-5 hours (e.g., 4 hours). The second step in the 3-stage aging practice is aging at a temperature slightly higher (e.g., at least about 20° F. higher) than the first step aging practice, such as in the range of about 225° F.-275° F. (e.g., 250° F.) for about 7-9 hours (e.g., 8 hours). The third step in the 3-step aging practice is aging at a temperature even higher than the second step aging practice (e.g., at least about 60° F. higher), such as in the range of 300° F.-340° F. (e.g., 320° F.) for about 12-16 hours (e.g., 12, 14 or 16 hours).

Prior to aging, the alloy may be produced via conventional techniques. The alloy may be wrought and solution heat treated (e.g., at 850° F.-900° F.) for a sufficient time based on the thickness of the alloy. After heat treatment, the alloy may be quenched and/or stress relieved (e.g., via stretching or compression of 1-5%). The thickness of a forged and heat treated alloy is generally in the range of 1-4 inches.

DETAILED DESCRIPTION

An alloy having a composition within the bounds of Alloy 1 of Table 1 is forged, solution heat treated, quenched, and artificially aged, as described above. 12×12 inch targets samples are produced from the forged alloy and have an average thickness of 1.653 inches. The samples have a beveled edge. The thickness of the samples is measured at the center of the sample using a coordinate measuring system.

Figure 1:
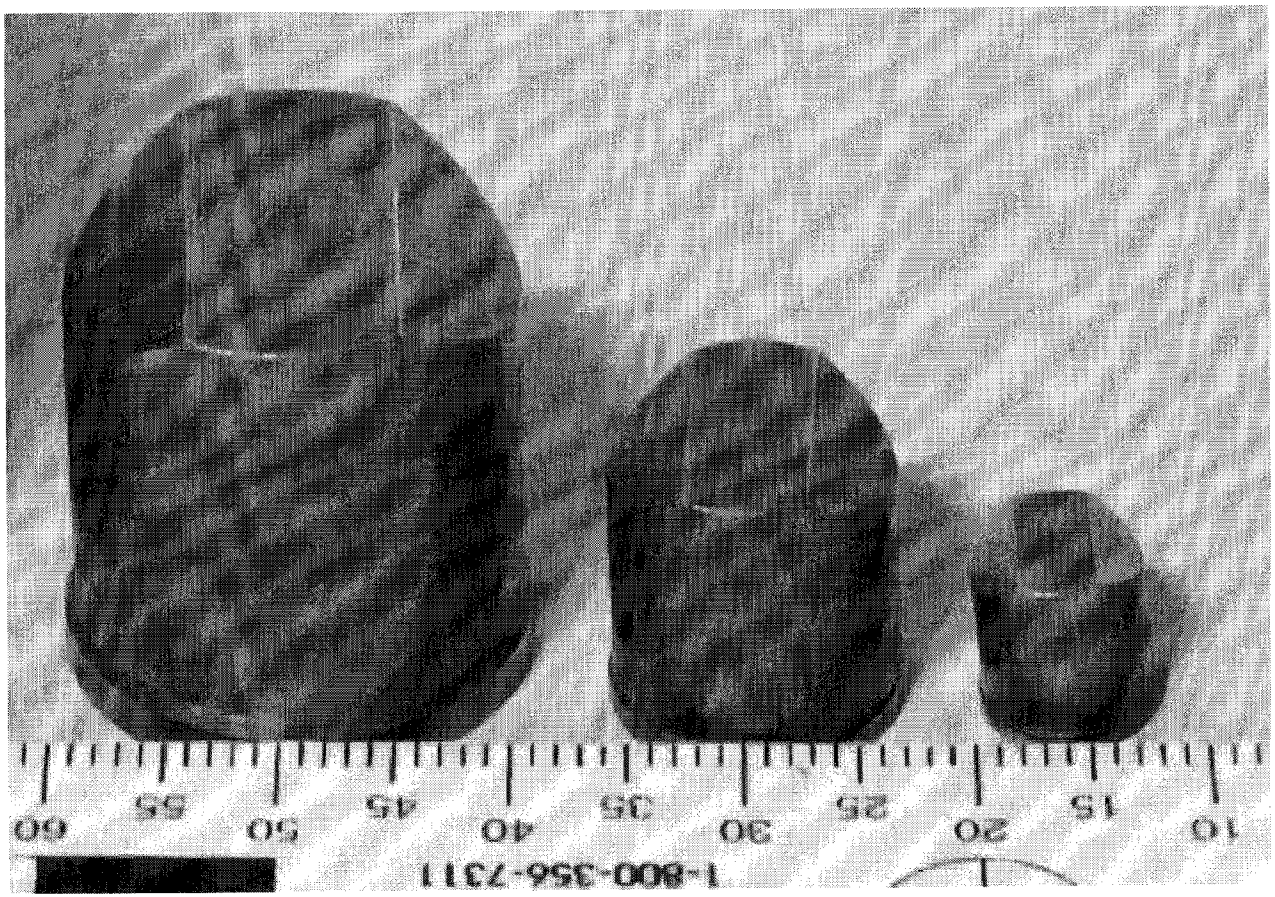
FIG. 1 is a photograph illustrating embodiments of fragment simulated particle (FSP) rounds.

Threat rounds are obtained to test the ballistics performance of the forged alloys. For FSP tests, 20 mm FSP rounds are used. The FSP rounds are manufactured in accordance with MIL-P-46593A. The rounds are hardened steel projectiles machined from 4340 steel and have a blunt nose. The FSP rounds weigh 830 grains, with an overall length of 0.912 inch and a main body diameter of 0.784 inch (all values are average). FIG. 1 illustrates embodiments of FSP rounds.

The AP rounds are American 0.30 cal APM2 rounds obtained from original U.S. military surplus ammunition. These rounds are hand-loaded to achieve the desired impact velocity. The 0.30 cal APM2 is an armor piercing round including a hardened steel core (Rc 63) contained within a copper/gliding metal jacket. A small amount of lead fill is also present in the round. The 0.30 APM2 rounds weigh about 165 grains with the armor piercing core accounting for about 80 grains.

FSP Testing Conditions

The alloy panels are tested for FSP resistance in accordance with MIL-STD-662F(1997). In particular, the FSP rounds are fired in the Medium Caliber Range. The FSP rounds are fired from rifled barrels without the use of sabots. The impact location and target obliquity are confirmed using a bore-mounted laser. All testing is completed in an indoor facility with the muzzle of the gun approximately 22 feet from the alloy panel targets.

AP Testing Conditions

The alloy panels are tested for AP resistance in accordance with MIL-STD-662F(1997). In particular, the AP rounds are fired utilizing a universal gun mount. A barrel chambered for a 30-06 Springfield cartridge is used to fire the APM2 projectiles. A bore mounted laser is used to align the gun with the desired impact locations on the target and to confirm target obliquity. All testing is completed in an indoor facility with the muzzle of the gun approximately 22 feet from the alloy panel targets.

Measurement of Impact Velocities

Projectile impact velocities are measured using two sets of Oehler Model 57 photoelectric chronographs located between the gun and the target. The spacing between each set of chronographs is 48 inches. A Hewlett Packard HP 53131A universal counter, triggered by the chronographs, is used to record the projectile travel time between screens. Projectile velocity is then calculated using the recorded travel times and the known travel distance. An average of the two calculated values is recorded as the screen velocity. The distance from the center of the screens to the impact location is approximately 4.1 feet. Unlike AP rounds, FSP rounds tend to slow down quickly due to their shape. Deceleration is taken into account by using the formulas for deceleration in AEP-55, "NATO AEP-55 VOL 1 ED 1 PROCEDURES FOR EVALUATING THE PROTECTION LEVEL OF LOGISTIC AND LIGHT ARMOURED VEHICLES VOLUME 1".

Target Holders

The aluminum alloy targets are held in a rigid target holder. The target holder is constructed out of 2 inches×4.1875 inches structural tubing forming a window frame with two long horizontal supports that are clamped to a large frame. The target is centered in the opening in the target holder—the opening is 10×10 inches. Each of the targets is impacted at the center of the sample.

Witness Panels

Witness panels are used during the test in accordance with MIL-STD-662F(1997). The panels are produced from a 2024-T3 aluminum alloy and have dimensions of 12 inches by 16 inches with a thickness of 0.020 inch. The witness panels are located approximately six inches behind the rear face of the alloy target sample.

Pass/Fail Criteria

Pass/fail for the testing is based on the ability of the armor target samples to stop the threat round and protect an aluminum witness panel located behind the target. If a witness panel is damaged such that light can pass through the witness panel, a complete penetration (fail) of the armor target sample occurs. This damage to the witness plate can be caused by either the projectile or spall. A partial penetration (pass) occurs if the witness panel is not perforated during the test.

FSP Results

Table 2, below, provides the results of the FSP ballistic testing and the corresponding strike velocities. The table is sorted by estimated strike velocity.

TABLE 2

FSP Results

| Test | Sample thickness (in) | Screen Velocity (fps) | Estimated Strike Velocity (fps) | Result |
|---|---|---|---|---|
| 3 | 1.6849 | 2978 | 2948 | Pass |
| 5 | 1.6574 | 3090 | 3059 | Pass |
| 10 | 1.6734 | 3126 | 3096 | Pass |
| 7 | 1.667 | 3144 | 3113 | Pass |
| 8 | 1.6373 | 3177 | 3145 | Fail |
| 4 | 1.6541 | 3192 | 3160 | Fail |
| 2 | 1.627 | 3200 | 3168 | Fail |
| 6 | 1.6755 | 3233 | 3201 | Fail |
| 1 | 1.6133 | 3308 | 3275 | Fail |
| 9 | 1.6343 | XX | XX | Fail |

Many of the FSP test samples do not span during the test and thus are considered spall resistant.

AP Results

Table 3, below, provides the results of the AP ballistic testing and the corresponding strike velocities. The table is sorted by estimated strike velocity.

TABLE 3

AP Results

| Test | Sample thickness (in) | Screen Velocity (fps) | Estimated Strike Velocity (fps) | Result |
|---|---|---|---|---|
| 11 | 1.655 | 2513 | 2513 | Pass |
| 12 | 1.655 | 2756 | 2756 | Pass |
| 13 | 1.655 | 2776 | 2776 | Pass |
| 14 | 1.655 | 2894 | 2894 | Pass |
| 15 | 1.655 | 2960 | 2960 | Pass |
| 18 | 1.655 | 2973 | 2973 | Pass |
| 19 | 1.655 | 2984 | 2984 | Fail |
| 17 | 1.655 | 3019 | 3019 | Fail |
| 16 | 1.655 | 3063 | 3063 | Fail |

All of the AP tests do not spall during the test and thus are considered spall resistant.

Summary of Results

Figure 2:
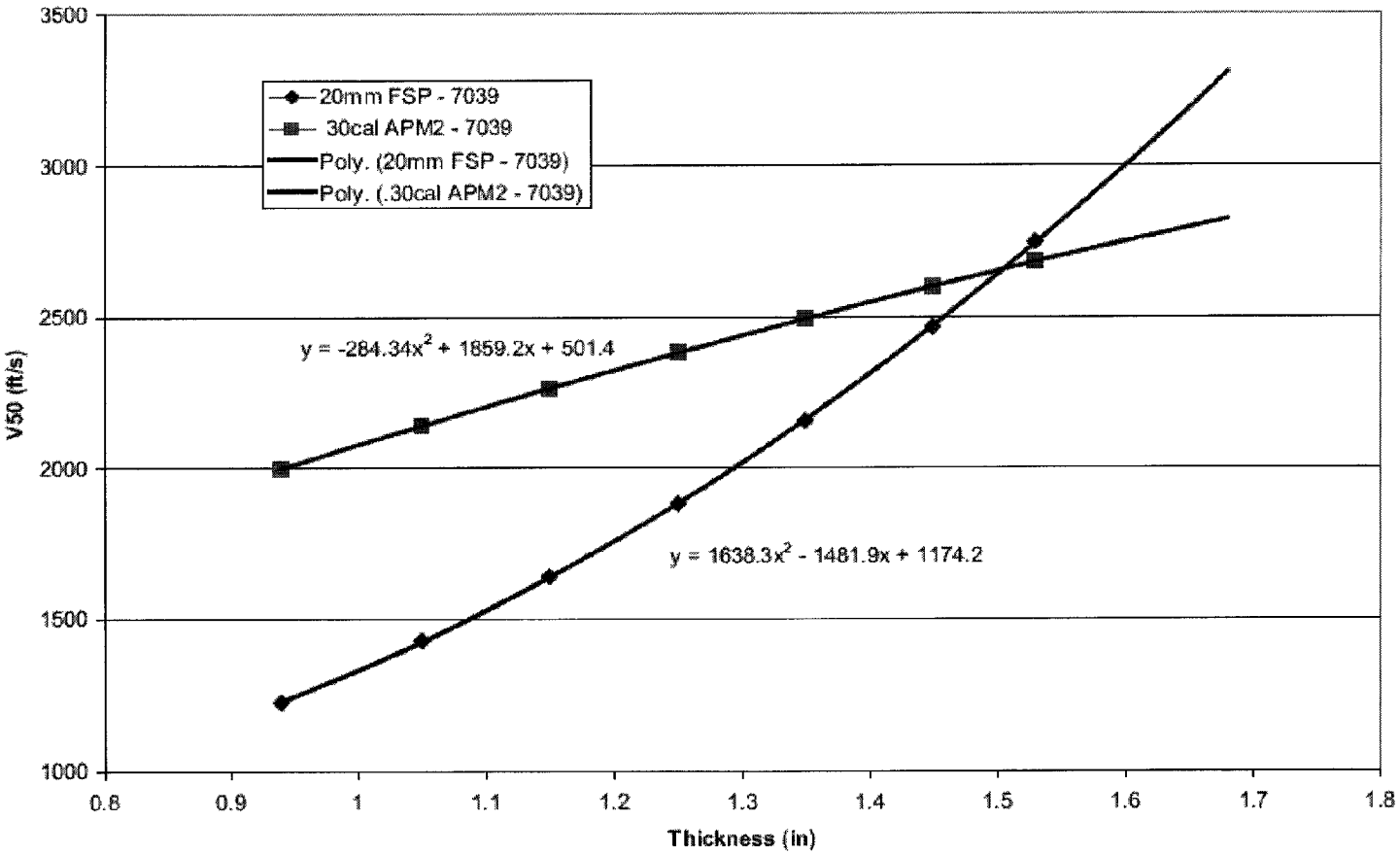
FIG. 2 is a graph estimating ballistics performance for prior art alloy AA7039.

Table 4 provides a summary of the V50 data for the samples. This data is also compared with the minimum values found in military specifications for AA5083 and AA7039. The AA7039 military specification only contains thickness of up to 1.53 inches, so a curve fit is performed to estimate AA7039 values on samples having a thickness of about 1.655 inches. This fit is illustrated in FIG. 2.

TABLE 4

Summary of test results and prior art alloy data

| | 20 mm FSP | 0.30 cal APM2 |
|---|---|---|
| Average sample thickness used in V50 (inches) | 1.658 | 1.655 |
| Thickness range of samples in V50 (inches) | 1.637-1.673 | 1.655 |
| Determined V50 (fps) | 3128 | 2984 |
| Spread of four shot V50 (fps) | 64 | 59 |
| Corresponding AA7039 V50 per MIL-DTL-46063H for Average (fps) | 3220 | 2800 |
| Corresponding AA5083 V50 per MIL-DTL-46027J (fps) | 2823 | 2501 |
| Corresponding AA7039 V50 for MIL-DTL-46063H for Min. Thick Sample (fps) | 3138 | 2800 |
| Corresponding AA7039 V50 for MIL-DTL-46027J for Min. Thick Sample (fps) | 2765 | 2501 |
| Historical data for AA7039-T6 | XX | 2900 |

In other words, the 7XXX alloys of the present disclosure achieve at least about 7% better AP resistance than the closest known prior art alloy of AA7039-T6, while achieving similar FSP resistance (thick sample). The 7XXX alloys are also 19% better in AP resistance than AA5083-H131 and are 11% better in FSP resistance than AA5083-H131. The new 7XXX alloys are also spall resistant, whereas the prior art alloys may not be spall resistant. Typical properties of the new 7XXX alloy, relative to forgings, are provided in Table 5, below.

TABLE 5

Typical Properties of New 7XXX Alloy

| Property | New 7XXX Alloy |
|---|---|
| Tensile yield strength (L) | 69 ksi |
| Ultimate tensile strength (L) | 75 ksi |
| Elongation (%) | 15 |
| Fracture Toughness | 84-52 ksi * sq.rt.in |
| Stress Corrosion Threshold | 35 ksi |

While various embodiments of the present disclosure have been described in detail, it is apparent that modifications and adaptations of those embodiments will occur to those skilled in the art. However, it is to be expressly understood that such modifications and adaptations are within the spirit and scope of the present disclosure.

What is claimed is:

1. An armor component produced from a 7XXX series aluminum alloy, wherein the aluminum alloy consists essentially of:

7.0-9.5 wt. % Zinc;

1.3-1.68 wt. % Mg;

1.2-1.9 wt. % Cu; and up to 0.4 wt. % of at least one grain structure control element;

the balance being aluminum and incidental elements and impurities;

(A) wherein the 7XXX alloy is in the form of a plate having a thickness of 1-4 inches;

(B) wherein the 7XXX alloy is sufficiently overaged to achieve:

(i) a fragment simulated particles $V_{50}$ ballistics limit of at least 2950 feet per second; and (ii) spall resistance as measured in accordance with MIL-STD-662F(1997); and (iii) a longitudinal tensile yield strength of not greater than 68 ksi.

2. The armor component of claim 1, wherein the 7XXX alloy achieves a tensile yield strength of at least 64 ksi.

3. The armor component of claim 1, wherein the 7XXX alloy achieves a tensile yield strength of at least 65 ksi.

4. The armor component of claim 1, wherein the 7XXX alloy achieves a tensile yield strength of at least 66 ksi.

* * * * *